US006776541B1

(12) United States Patent
Takahashi

(10) Patent No.: US 6,776,541 B1
(45) Date of Patent: Aug. 17, 2004

(54) DUAL X-RAY FILM DEVELOPING APPARATUS

(76) Inventor: Jeff E. Takahashi, 4582 Rhapsody Dr., Huntington Beach, CA (US) 92649

( * ) Notice: Subject to any disclaimer, the term of this patent is extended or adjusted under 35 U.S.C. 154(b) by 0 days.

(21) Appl. No.: 10/644,165

(22) Filed: Aug. 21, 2003

(51) Int. Cl.[7] ..... G03D 3/08
(52) U.S. Cl. ..... 396/626; 396/636; 355/27
(58) Field of Search ..... 396/626, 636, 396/620; 355/27–29; 134/64 P, 64 R, 122 P, 122 R

(56) References Cited

U.S. PATENT DOCUMENTS 6,508,599 B2 * 1/2003 Blume ..... 396/617

* cited by examiner

*Primary Examiner*—D. Rutledge
(74) *Attorney, Agent, or Firm*—Alfred E. Miller

(57) ABSTRACT

A dual X-ray film-processing device having developer and fixer liquid receptacles connected to film processing tanks by twin chemical pumps through piping having valves therein whereby X-ray film for dental or medical use is being processed continuously thereby speeding up production while at the same time improving the resultant X-ray film surface image.

10 Claims, 5 Drawing Sheets

DUAL X-RAY FILM DEVELOPING APPARATUS

This invention relates to an apparatus having two film processing tanks for continuous operation and having both a developer and a fixer liquid reservoir. The apparatus further includes a film washing arrangement as well as heating and temperature controls. Twin chemical pumps equalize the liquid flow though both the developer and fixer reservoirs. The pumps are connected to each film-processing tank by means of valves. The apparatus has an independent water reservoir for washing the processed film while a heated blower dries the film after the water rinse.

BACKGROUND OF THE INVENTION

It is recognized in X-ray film processing for dental or medical use the in order to create the best possible image it is necessary to have fast in and out flow of the liquid in new tanks. As the developer used in the process reaches the film-processing tank every second that passes before the film reaches the tank changes the surface image. In order to improve the X-ray film image the present apparatus provides for fast and equal movement of the liquid through the tanks of the apparatus having two film processing tanks for continuous operation in which both the developer and fixer liquid reservoir tanks are heated and automatic temperature controlled in order to maintain optimum film developing.

A photographic processing apparatus is shown in U.S. Pat. No. 3,873,988 to Pfeifer et al., which has two rows, one above the other, of developing, fixing and rinsing chambers, and a dryer for each rinsing chamber. It is stated that an important advantage of the apparatus is not that the capacity is double that of a conventional apparatus, but that the apparatus does not take up additional floor space that exceeds that of conventional apparatus. In addition, the Pfeifer et al. patent, although it has two film processing rows, the rows are not interconnected, but operate independently so that rapid, continuous X-ray film developing, as in the present invention, can not be accomplished. It is clear that the patent to Pfeifer et al. does not have the concept and structural arrangement in the present invention in which a dual X-ray developing device is provided which results in faster fluid flow and equal liquid movement in continuous uninterrupted film developing.

The present invention system and apparatus, because it has dual film processing tanks, permits a large quantity of film to be developed in a continuous operation by means of twin chemical pumps and associated valves.

DESCRIPTION OF THE DRAWINGS

In order that the invention may be more clearly understood it will now be disclosed in greater detail with reference to the accompanying drawings, in which.

DESCRIPTION OF THE PREFERRED EMBODIMENT

Figure 1:
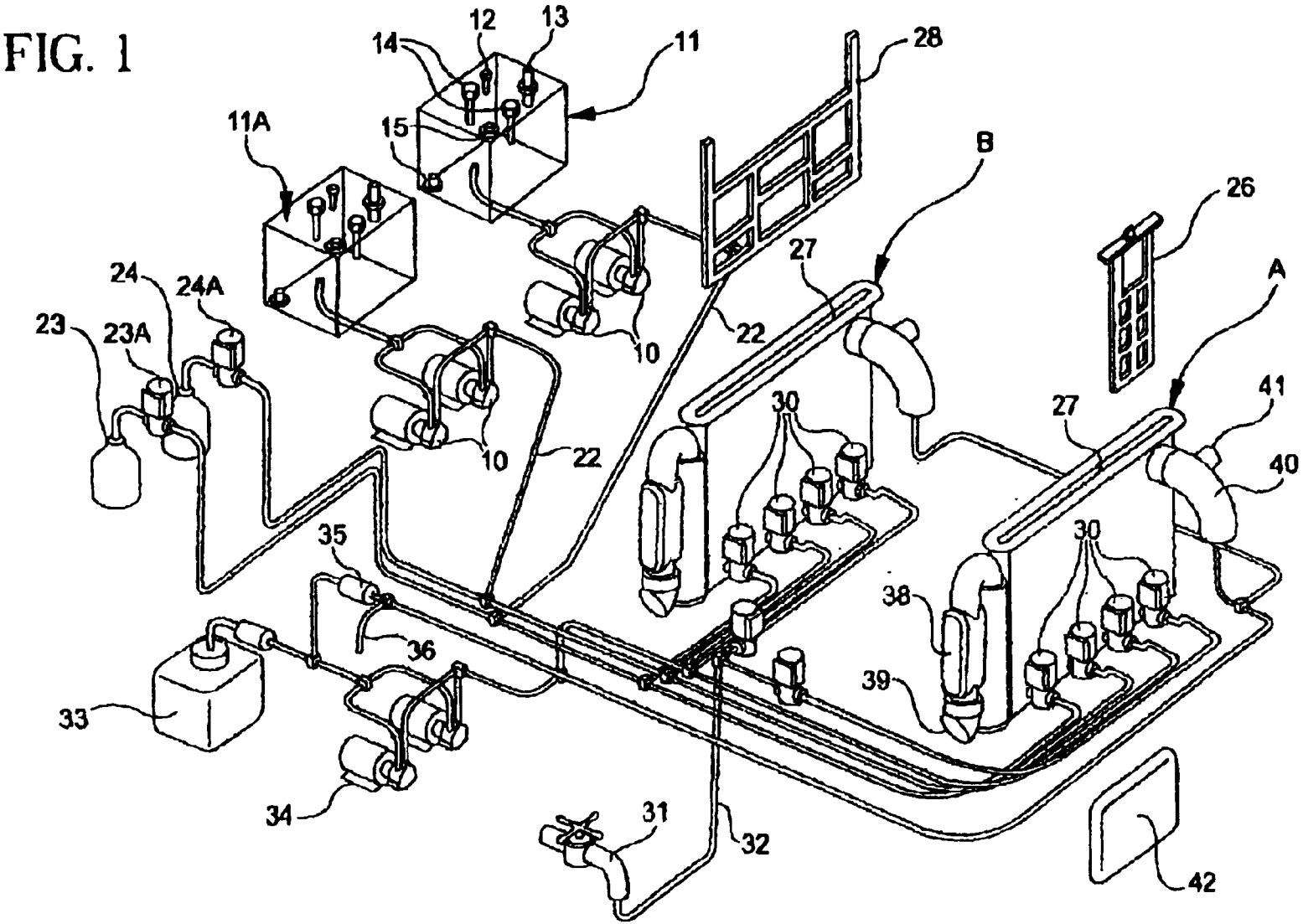
FIG. 1 is a perspective drawing of the X-ray film developing apparatus in accordance with the teachings of the invention.
Figure 2:
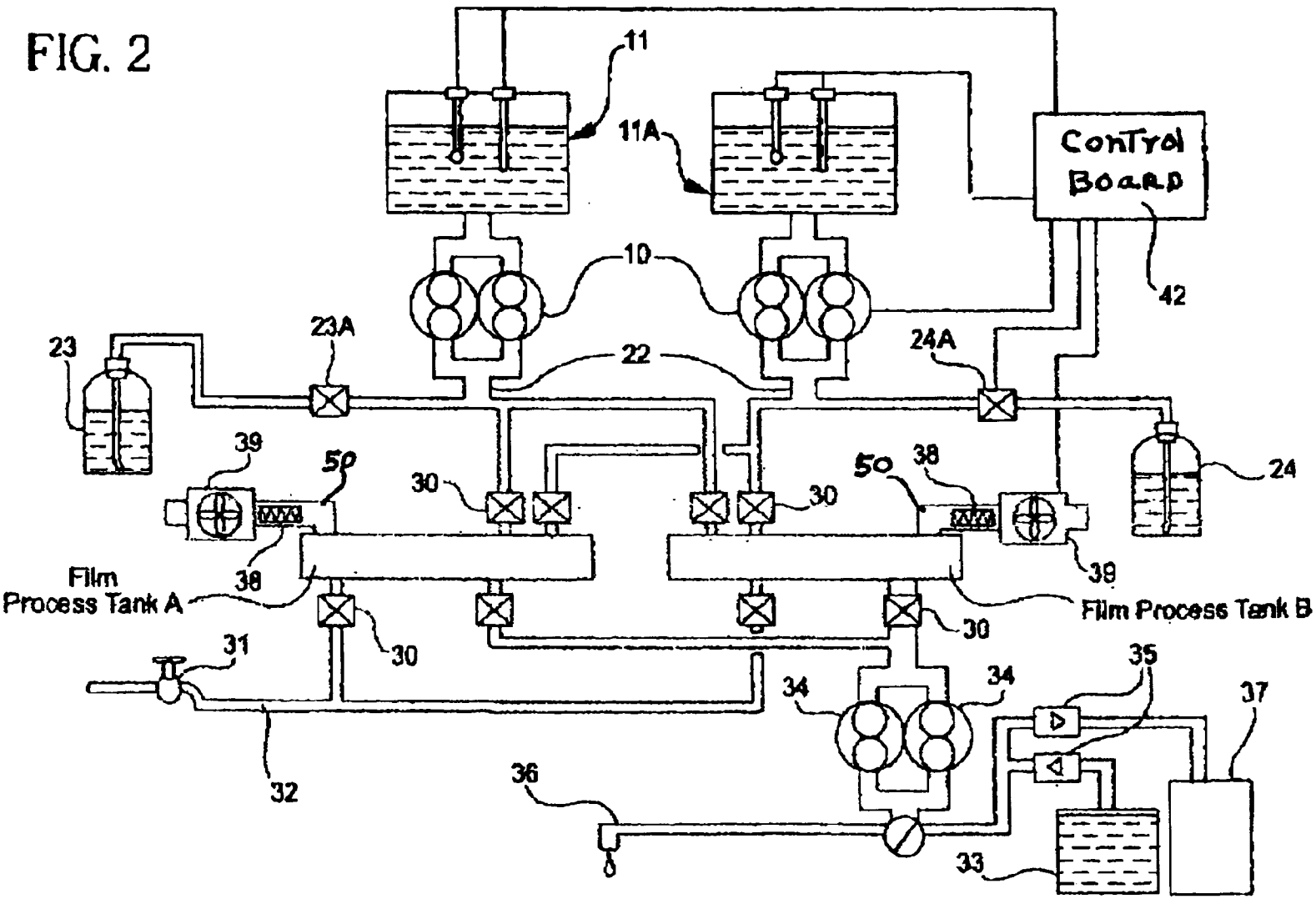
FIG. 2 is a schematic drawing of the apparatus shown in FIG. 1.
Figure 4:
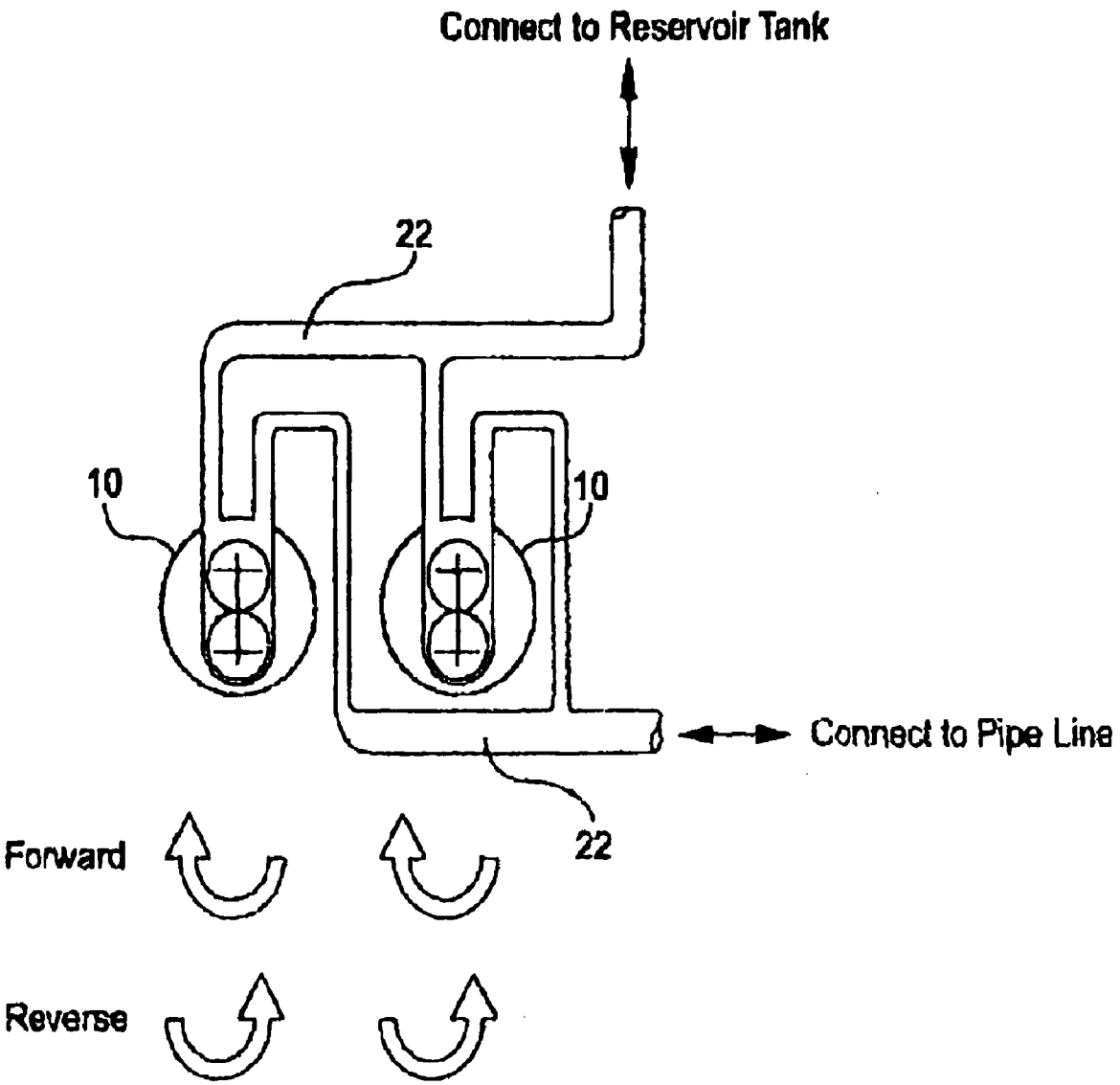
FIG. 4 is a schematic drawing of the twin chemical pumps and associated manifold pipes and FIG. 5 of the film processing tank with a heater and blower and equalizing fins for equalizing the air flow through the film process tank.

Referring to FIGS. 1 and 2, the present film developing apparatus has two independent developer and fixer liquid reservoir tanks 11 and 11A. Each tank has a temperature sensor 12, a thermal switch 13, a thermal control heater 14 and a level sensor 15 inside the respective tanks. It should be noted that during film processing it is important to maintain precise temperature and processing times in order to create the best possible X-ray image. Both reservoir tanks are connected by electrical and chemical pumps 10 through a manifold pipe 22, which result in faster fluid flow and equal liquid movement. As seen in FIG. 4, the manifold pipe 22 is considerably larger than the pump intake and out pipes so that the fluid moves faster in the system. The pumps 10 also operate forward and reverse, and if one fails, the other pumps continue to operate. The fast and equal liquid movement in and out of the tank is important since the surface image of the film changes every second. The pumps create pressure in the system; consequently the gravity effect on the flow of liquid is not important.

Connected by a valve 23A to the pump is a developer replenish bottle 23. It should be recognized that the developer and fixer gets older and less effective upon continued use. After a number of processes are completed by the film developing apparatus, the valve 23*a* opens and a small amount of new fluid agents from both the developer bottle 23 and fixer replenish bottle 24 through valve 24*a* are introduced first into the respective reservoir tanks until the required temperature is reached and thereafter pumped into the film processing tanks A and B in order to keep the processing chemicals fresh.

The present system or apparatus has dual X-ray film processing tanks A and B that have elongated openings 27. This arrangement allows a large quantity of film to develop at one time. As seen in FIG. 1, either a small film cartridge 26 can be used or a large film cartridge 28 can be utilized. Three small cartridges can be accommodated in the processing tanks. Thus, a large quantity of X-ray film can be developed at one time by permitting continuous operation. Consequently, while one film is being processed in the developer tank, the other film-processing tank does the fixing, and the twin chemical pumps 10 and associated valves 30 control the whole system.

The apparatus can be connected to a water faucet 31 through a pipe 32. If the user does not have a water connection, water can be brought in from a bottle or container. It addition, water pumps 34 for the water tank 33 can be utilized which are equipped with directional check valves 35 whereby the pump 34 moves fresh water in for film rinsing, and waste water out to the drains 36, or to waste drain tank 37, thus eliminating vacating strong chemicals into the city sewer systems. Each film-processing tank A and B is provided with an overflow pipe 40 and an air exhausting duct 41.

Figure 3:
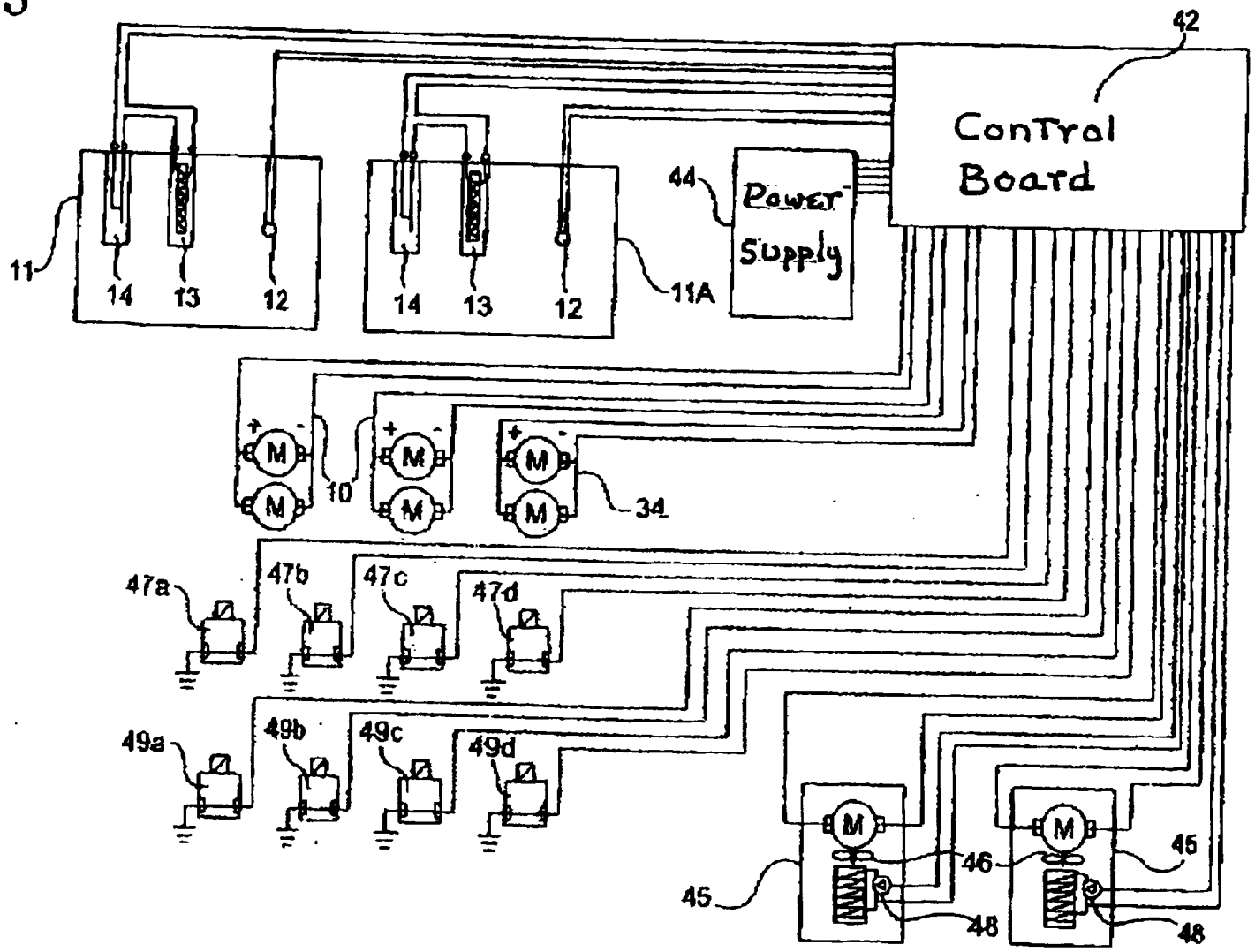
FIG. 3 is a schematic drawing of the microprocessor control board and its connections to various elements of the present apparatus.

The electronic control box 42 and its connections to the elements of the present X-ray film-developing apparatus is shown in greater detail in the schematic diagram of FIG. 3. The set of controls shown in FIG. 3 are developer control unit 47*a*, fixer control unit 47*b*, water tank control unit 47*c* and faucet control unit 47*d*, all of which are connected to film processing tank A.

The other set of controls which are shown in FIG. 3 are developer control 49*a*, fixer control unit 49*b*, water tank control unit 49*c*, and faucet control unit 49*d*, all of which are connected to film processing tank B.

Each film-processing tank A and B is provided with an air duct 50 having a separate heater 38 with a fan 39. The heated air blower supplies equal airflow to the surface of the X-ray film, which helps the film dry faster, and equally without creating a watermark on the film.

Figure 5:
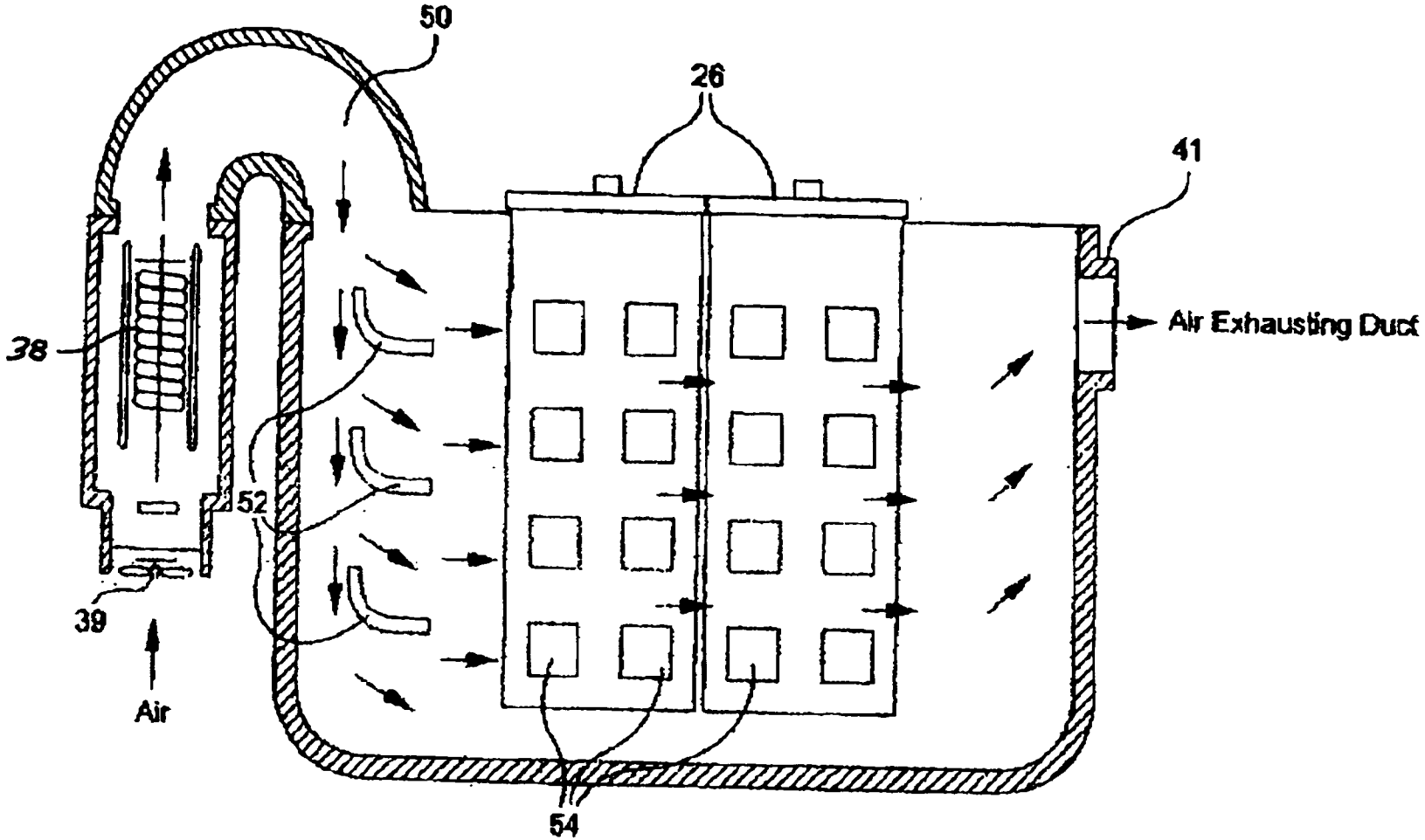

FIG. 3 further shows a diagram of the microprocessor control board 42 having a power supply 44. Each heater element 45 in the film dryer is provided with a bi-metallic temperature limiter 48. FIG. 5 shows the heater 38, fan 39 and air duct 50 is provided with equalizing fins 52 so that there is equal air movement through the film processing tanks showing film cartridges mounting X-ray film 54.

It should be noted that both film-processing tanks A and B are initially filled with developer, and after a timed period, the liquid developer is pumped out of the tank. Thereafter, at the end of the timed period the fixer liquid is pumped into the same tank. After a set period of time the fixer liquid is pumped out of the tank, and washer fluid is introduced into the tank. The final step is the introduction of heated air into the tank in order to dry the film cartridge that has been developed. The apparatus is so designed that continuous developing is accomplished with precise timing for both small and large film cartridges.

While it has been shown and described an embodiment of the present invention, it will be understood that various changes in the form and details of the apparatus illustrated, as well as its operation, may be made without departing from the true spirit of the invention.

What is claimed is:

1. A dual X-ray film apparatus a developer fluid reservoir, a fixer fluid reservoir, an arrangement including a first film processing tank, a pair of chemical pumps in communication with said developer reservoir, a manifold pipe having values therein connecting said pumps alternately to said first and second film processing, said apparatus resulting in a fast fluid flow an substantially equal liquid movement, means providing water to said film processing tanks for rinsing, and an air inlet having a heated air blower therein for drying said film.

2. The dual X-ray film developing apparatus as claimed in claim 1 further comprising a receptacle for replenishing liquid developer fluid, and pipe means provided with at least one valve delivering said developer fluid to said developer reservoir and said film processing tanks.

3. The dual X-ray film developing apparatus as claimed in claim 1 further comprising a microprocessor control for said apparatus.

4. The dual X-ray film developing apparatus as claimed in claim 1 wherein said air duct has spaced fins whereby said air blower supplies equal airflow to the surface of the film causing the film to dry faster.

5. The dual X-ray film developing apparatus as claimed in claim 1 further comprising a receptacle for replenish fixer fluid, and pipe means provided with at least one valve for delivering said fixer fluid to said fixer reservoir and said film processing tanks.

6. A dual X-ray film developing apparatus as claimed in claim 1 further comprising a water tank having a pipe provided with a directional valve and dual pumps for moving fresh water through said pipe selectively into said film processing tanks.

7. A dual X-ray film developing apparatus as claimed in claim 1 wherein each of said film processing tank has an elongated opening in which one large film cartridge or three small film film processing tank has an elongated opening in which one large film cartridge or three small film cartridges can be inserted.

8. A dual X-ray film developing apparatus comprising a developer fluid reservoir, a fixer, fluid reservoir, each said developer reservoir having a temperature sensor, a heater and a thermal switch, an arrangement including a first film processing tank and a second film processing tank, a first pair of chemical pumps in communication with said developer reservoir, a first manifold pipe having at least one valve therein connecting said pumps alternately to said first and second film processing tanks, a second pair of chemical pumps in communication with said fixer reservoir, a second manifold pipe having at least one valve therein connecting said pumps alternately to said first and second film processing tanks, said apparatus resulting in a fast fluid flow and substantially equal liquid movement, means providing water to said film processing tanks for film rinsing, and a heated air blower for drying said film.

9. A dual X-ray film developing apparatus as claimed in claim 5 further comprising a waste water drain, a waste water drain tank for receiving the waste water and used developer and fixer.

10. A dual X-ray film apparatus comprising a developer fluid reservoir, a fixer fluid reservoir, an arrangement including a first film processing tank, a second film processing tank, a first pair of chemical pumps with means for connecting said first pair of chemical pumps to said developer reservoir, a second pair of chemical pumps to said fixer reservoir, a first manifold pipe having valves therein connecting said first pair of chemical pumps with means for connecting said second pair of chemical pumps to said first and second processing tanks, a second manifold pipe having valves therein connecting said second pair of chemical pumps to said first and second film processing tanks, said arrangement resulting in fluid flow and equal liquid movement, means providing a water supply for film rinsing, a waste water tank having a pipe connecting said film processing tanks to said waste water tank for receiving used waste water, and a heated air blower for drying said film.

* * * * *